US008740717B2

(12) United States Patent
Stites

(10) Patent No.: US 8,740,717 B2
(45) **Date of Patent: *Jun. 3, 2014**

(54) VARIED PROFILE ALIGNMENT AIDE GOLF CLUB HEAD

(71) Applicant: NIKE, Inc., Beaverton, OR (US)

(72) Inventor: John T. Stites, Weatherford, TX (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/735,474

(22) Filed: Jan. 7, 2013

(65) Prior Publication Data

US 2013/0123036 A1 May 16, 2013

Related U.S. Application Data

(63) Continuation of application No. 12/712,822, filed on Feb. 25, 2010, now Pat. No. 8,348,780.

(51) Int. Cl.
*A63B 69/36* (2006.01)
*A63B 53/04* (2006.01)

(52) U.S. Cl.
USPC ..... 473/231; 473/238; 473/242; 473/244; 473/324

(58) Field of Classification Search
USPC ..... 473/219, 226, 231–256, 324; D21/759
See application file for complete search history.

(56) References Cited

U.S. PATENT DOCUMENTS

| | | | | |
|---|---|---|---|---|
| 1,485,272 | A * | 2/1924 | Kinsman | 473/242 |
| D89,332 | S | 2/1933 | Bartsch | |
| 2,781,197 | A | 2/1957 | Wiley | |
| 2,934,347 | A | 4/1960 | Siniscalchi | |
| 3,333,854 | A | 8/1967 | White | |
| 3,649,028 | A * | 3/1972 | Worrell | 473/220 |
| 3,884,477 | A | 5/1975 | Bianco | |
| D312,858 | S | 12/1990 | Anderson et al. | |
| 4,974,851 | A | 12/1990 | Closser et al. | |
| 5,244,210 | A | 9/1993 | Au | |
| 5,366,223 | A | 11/1994 | Werner et al. | |
| 5,433,446 | A | 7/1995 | Lindstedt, Jr. | |

(Continued)

FOREIGN PATENT DOCUMENTS

| | | |
|---|---|---|
| EP | 0786272 | 7/1997 |
| GB | 167956 | 8/1921 |

OTHER PUBLICATIONS

International Search Report and Written Opinion, mailed Jun. 17, 2011, issued in corresponding International Patent Application No. PCT/US2011/024289.

*Primary Examiner* — Sebastiano Passaniti

(57) ABSTRACT

A golf club head in which a top surface of the body includes an actual top surface visible profile region and a varied top surface visible profile region is provided. The varied top surface visible profile region may provide a visual impression of a varied profile of the body distinct from an actual profile of the body. The visual impression is oriented in a manner that allows the golfer to address the ball at the heel region of the golf club. The perimeter of the top surface visible profile region may be complementary in shape to the perimeter of the top surface of the body and the varied top surface visible profile region and the actual top surface visible profile region may be distinct in shape, size, color, and/or finish etc. An associated golf club and a method for fitting a golf club are also provided.

14 Claims, 12 Drawing Sheets

(56) References Cited

U.S. PATENT DOCUMENTS

| | | | | |
|---|---|---|---|---|
| 5,839,970 | A | 11/1998 | Lombardo | |
| 6,086,484 | A | 7/2000 | Uebelhor | |
| 6,722,998 | B1 | 4/2004 | Miller | |
| D500,824 | S | 1/2005 | Imamoto | |
| D502,520 | S | 3/2005 | Dogan et al. | |
| 6,860,817 | B2 | 3/2005 | Middleton | |
| D524,398 | S * | 7/2006 | Madore et al. | D21/759 |
| D524,399 | S | 7/2006 | Madore et al. | |
| D529,564 | S | 10/2006 | Grace | |
| D544,560 | S * | 6/2007 | Oldknow | D21/759 |
| D577,405 | S * | 9/2008 | Oldknow et al. | D21/759 |
| D584,784 | S | 1/2009 | Barez et al. | |
| 8,128,506 | B2 | 3/2012 | Quirk | |
| 8,348,780 | B2 * | 1/2013 | Stites | 473/231 |
| 2003/0148821 | A1 | 8/2003 | Morgan et al. | |
| 2004/0074125 | A1 | 4/2004 | Johnson | |
| 2007/0004524 | A1 | 1/2007 | Harrison | |
| 2008/0254907 | A1 | 10/2008 | Swartz et al. | |
| 2008/0261712 | A1 | 10/2008 | Quirk | |
| 2009/0314398 | A1 | 12/2009 | Shaar, Jr. | |
| 2010/0292019 | A1 | 11/2010 | Stites | |

* cited by examiner

VARIED PROFILE ALIGNMENT AIDE GOLF CLUB HEAD

CROSS-REFERENCE TO RELATED APPLICATION

This application is a continuation of pending U.S. patent application Ser. No. 12/712,822, filed on Feb. 25, 2010, the contents of which is incorporated herein by reference in its entirety.

FIELD OF THE INVENTION

The present invention relates to a golf club, more particularly, to a golf club head with a visual reminder alignment aide.

BACKGROUND

The alignment of a golfer including the initial addressing and positioning of the golfer's golf club head in relation to the golf ball before beginning his swing is often related to the golfer's performance on the golf course. Golfers that can consistently and properly align a golf club including a golf club head in a preferred manner often will hit the golf ball farther, straighter and in a more consistent manner. Accuracy, control and/or direction may be improved when a golfer's alignment including his initial alignment has certain attributes that allows the resulting swing including the backswing, downswing, and orientation at point of contact to have preferred characteristics and positioning. However, many golfers have difficulty striking the golf ball in a preferred manner because of improper alignment or an alignment that increases the likelihood the golfer does not strike the golf ball in a preferred position, orientation and/or manner. As a result, the golfer's performance and score are negatively affected.

SUMMARY

Inventive aspects pertain to a golf club head in which a top surface of the body includes an actual top surface visible profile region and a varied top surface visible profile region. The varied top surface visible profile region may provide a visual impression of a varied profile of the body distinct from an actual profile of the body. The perimeter of the top surface visible profile region may be complementary in shape to the perimeter of the top surface of the body. The varied top surface visible profile region and the actual top surface visible profile region may be distinct in shape, size, color, and/or finish etc.

Additionally, inventive aspects also relate to a wood-type golf club with a body, a shaft coupled to the body at a hosel, and a top surface housed on the body. The top surface provides a visual impression of the body of the golf club head having a varied profile distinct to an actual profile. In the varied profile a midpoint between a varied toe end and a varied heel end is closer to a heel end of the body than a midpoint between the toe end and heel end of the body.

Further inventive aspects relate to a method of fitting a golf club by determining an actual region of contact on a hitting surface on a front surface of a body of a golf club head using a measuring device, determining a desired region of contact on the hitting surface, and applying a varied top surface profile application to a top surface of the golf club head based upon the determined desired location of contact by applying one of a coating, a film, an adhesive tape and an appliqué to form a varied profile of the body based upon the determined actual region of contact.

DESCRIPTION OF THE DRAWINGS

The foregoing Summary of the Invention, as well as the following Detailed Description of the Invention, will be better understood when read in conjunction with the accompanying drawings.

DETAILED DESCRIPTION

Figure 1A:
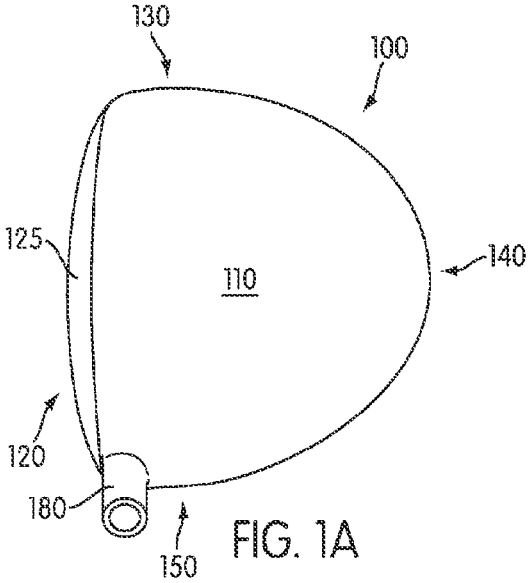
FIGS. 1A-1D are illustrative top plan, toe end, heel end and front views respectively of a golf club head.
Figure 1B:
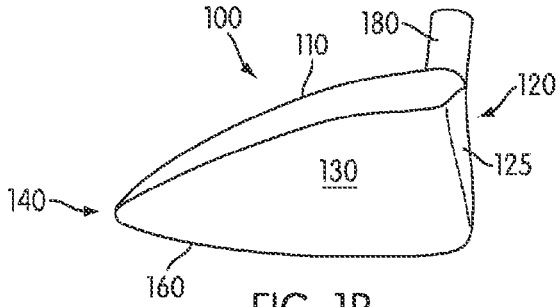
Figure 1C:
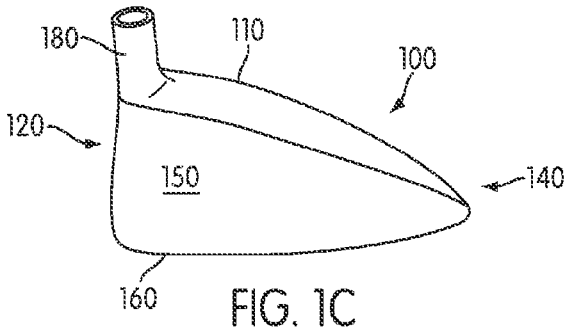
Figure 1D:
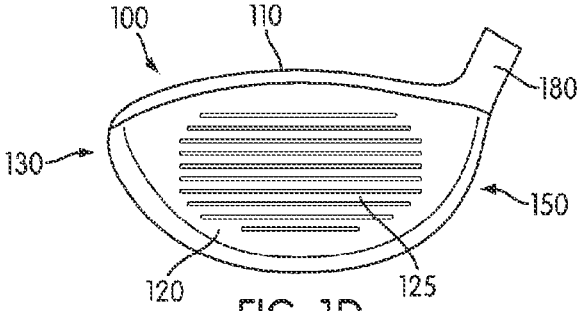

In the following description of the various embodiments, reference is made to the accompanying drawings that depict illustrative arrangements in which the invention may be practiced. It is understood that other embodiments may be utilized and modifications may be made without departing from the scope of the present invention. Additionally, various terms used herein are defined below.

FIGS. 1A-1D are schematic top, toe end, a heel end and front views, respectively, of an illustrative golf club head 100. As is apparent from the figures, a golf club head may illustratively be considered to include a top 110, a front 120, a toe end 130, a rear 140, a heel end 150 and a bottom (or sole) 160. Further, a golf club head 100 typically includes a hosel 180 formed to, among other things, facilitate connection of the golf club head 100 to the shaft 190. Hosel(s) 180 and shaft(s) 190 are well known in the art. Hosels 180 are commonly formed with the remainder of the golf club head 100 as a single body member.

Front surface 120 typically houses a hitting surface 125 configured for striking a golf ball. Hitting surface 125 may include any of a variety of features, configurations, shapes, surfaces and details. For example, hitting surface 125 may include a series of horizontal grooves that facilitate desired flight of the golf ball when the hitting surface 125 impacts a golf ball. Spacing, size, depth, shape, contour and orientation of these grooves may be varied based on club type (and/or particular club manufacturer) to achieve a desired ball flight characteristic. Also, hitting surface 125 may be formed of a hardened material or may be treated to strengthen or harden the material in anticipation of the hitting surface repeatedly being used to impact the golf ball. Many other forms of surface treatments and ornamentation may be incorporated into the hitting surface 125, from hardened materials to holes, grooves, and corrugation and various other hitting surface materials, structures and configurations that are well known. The illustrative golf club head 100 illustratively shown in FIGS. 1A-1D may be commonly referred to as a "wood-type" golf club head. Wood-type golf heads may include drivers, fairway woods, hybrids clubs and other golf club heads. However, other golf club heads including "iron-type" golf club heads, putters and any other golf club heads are contemplated with regard to FIGS. 1A-1D and the corresponding illustrative features described above.

Figure 2:
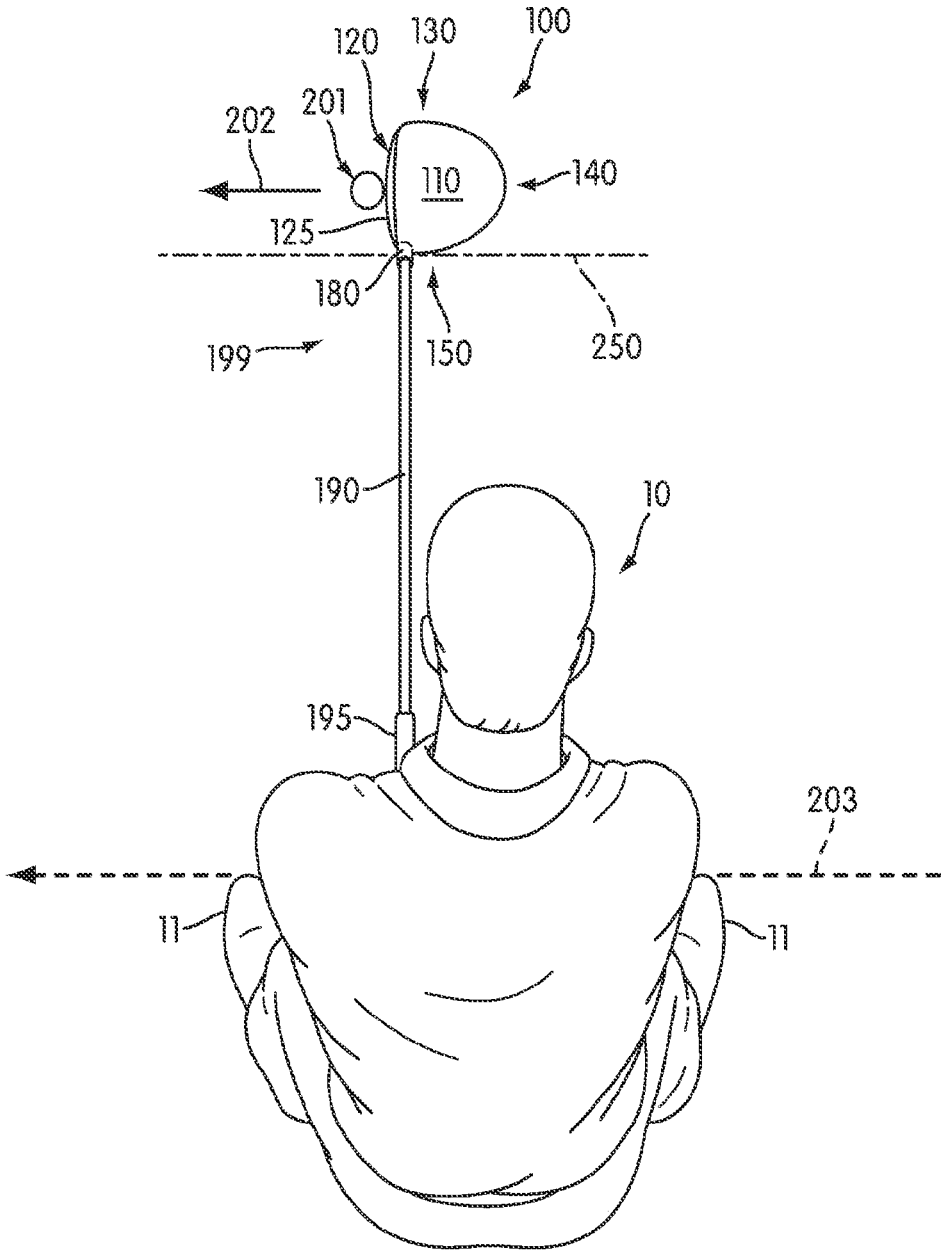
FIG. 2 is an illustrative top plan view of a golfer addressing a golf ball with a golf club including a golf club head coupled to a shaft.

FIG. 2 is an illustrative top plan view of a golfer 10 addressing a golf ball 201 with a golf club head 100. The addressing state shown in FIG. 2 is generally considered a start position for a golfer's swing for hitting a golf ball 201. The golf club 199 typically includes a shaft 190 coupled to the head 100 at the hosel 180. A grip 195, by which a golfer 10 holds or grips the golf club, is attached to the shaft 190 at the end opposite the head 100. Grips 195 are known and may vary significantly depending on preferences, ergonomic characteristics, and tendencies of the golfer, such as a tendency to hit a slice or a fade. For example, grips vary in "grip size" and in circumference. They also vary in particular texture and grip pattern on the outer surface of the grip. Grips can be round or may have a line or rib on the underside to assist the golfer in placement of his hands. Other shapes are also contemplated. Grips may be composed of a number of materials including rubbers, polymers, and leather, to name a few. The grip traits may be varied by, for example, by making the grip corded or selecting any of various materials based upon the frictional properties of that material.

Shaft 190, as is also known in the art, may be varied in length, material composition, stiffness, flex and other traits and features. For example, golfers may select shafts formed of a variety of materials in light of characteristics of those materials. For example, flex and stiffness are among the illustrative characteristics that may be contemplated when selecting a particular shaft or shaft material as a preferred shaft stiffness may vary from golfer to golfer depending on skill, strength and swing characteristics including swing speed or swing path. In at least one categorization system, shafts may be categorized as Extra Stiff, Stiff, Regular, Senior and Ladies depending on the particular flex characteristics. Like other golf club features, the shaft 190 and grip 195 will often be selected based upon golfer "feel" as well as traits relating to the golfers physical make-up and swing characteristics and tendencies.

As is apparent in FIG. 2, golfers generally position their feet 11 in an orientation generally aligned in the direction in which the golfer desires or is aiming to hit the golf ball 201. Although, depending on golfer preference and particular type of club being used (driver versus 5-iron versus wedge), foot positioning may be varied from this illustrative positioning as is known in the art so as to be askew by a certain rotation from the general desired travel path. For illustrative purposes in FIG. 2, arrow 202 demonstrates a "general" desired travel path of the ball 201 after the golfer 10 strikes the golf ball 201 with the front 120 (the face) of the golf club 199. The golfer's feet alignment, as demonstrated by the arrow 203, illustratively depicts the golfer's stance as being generally parallel with the general desired travel path of the ball 202. As is known, an actual travel path 202 of the ball 201 may vary from the general desired travel path as a golfer may either hit a "fade" or a "slice" of varying degrees. Likewise, the ball's flight may vary in its initial direction and general flight path curve, however, it may be desired that the ball be curved back to finish in general alignment with the general desired travel path of the ball 201. Additionally, for reference purposes, broken line 250 illustrates a heel end plane running along the heel end 150 of the golf club head and perpendicular to the ground (assuming the ground is flat). As is apparent when the golfer 10 is in a typical addressing state as shown in FIG. 2, the heel end plane 250 is parallel to the general desired travel path 202 and the golfer's feet alignment 203.

Less skilled or high handicap golfers (e.g. a player that has a higher number as their "handicap" according to the well known handicapping system of rating golfers based upon their play and scores) typically have swing tendencies that differ from the preferred methods and mechanics of swinging of golf club to achieve preferred and optimal performance and results. A less skilled or high handicap golfer's swing and play may be distinguished from the play of a professional golfer or other golfers that may perform swings in a preferred manner. For example, less skilled golfers may often hit the golf ball on the toe end 130 of the hitting surface 125 of the front surface 120 of the golf club head rather than in the center or the "sweet spot" of the golf club head 100. For example, most golfers hit a golf ball a half inch further towards the toe end 130 of the golf club head than compared to where the ball was initially positioned during alignment. As such, performance may suffer as the golf ball will not travel with a desired distance of travel and/or path of travel. Less skilled golfers are sometimes unaware of this swing tendency or unable to fix this swing tendency as golfers typically begin a golf swing with the golf ball aligned between the toe end 130 and heel end 150 of the front surface 120 of the golf club head in a generally centrally located position in the "sweet spot." (See e.g., FIG. 2) However, because of several swing traits and tendencies of the high handicap golfer, despite being centered and aligned at the beginning of the golf swing, when the less skilled golfer strikes the golf ball the ball will not be in the same position relative to the golf club head as it was at the beginning of the golf swing when the golfer was in the addressing state. Some illustrative causes of this varied orientation and position are discussed further below with respect to FIGS. 3A-4B.

Generally, most golfers start with an alignment in which the golf ball is centered on the golf club head as it is a common human tendency to line things up in the center of objects. One reason for centering such an alignment is a belief that this alignment will minimize errors and miss hits. Accordingly, golfers often align the center of the face or hitting surface 125 of the golf club with the ball in a center alignment. However, as a result of shaft droop and/or improper swing path from outside to inside, it is common for golfers to have a strike point with the golf ball that is more towards the toe that their original centered alignment. For instance, a golfer may strike a golf ball at a strike point on the golf club that is ¼ to ½ inch further toward the toe end 130 than its original alignment position. While the degree of variance may change from golfer to golfer including variances of less than ¼ inch or more than ½ inch, many golfers will exhibit some general tendency to hit the ball such that the ball is contacting the face or front surface 120 of the golf club head further towards the toe end 130 than where the golfer was originally intending as demonstrated by the alignment when the golfer addressed the golf ball before his swing. Accordingly, it is preferred that golfers start with an alignment in which the ball is positioned on the heel end 150 side of center and then the golf ball will then be centered on the front surface 120 of the golf club head 100 when the golfer strikes the ball during his shot. However, as described, such an alignment is unnatural based on human natural tendencies since the alignment is and appears off-center. As such, the golf club head 100 and the method described herein assist in overcoming the described human tendency.

Figure 3A:
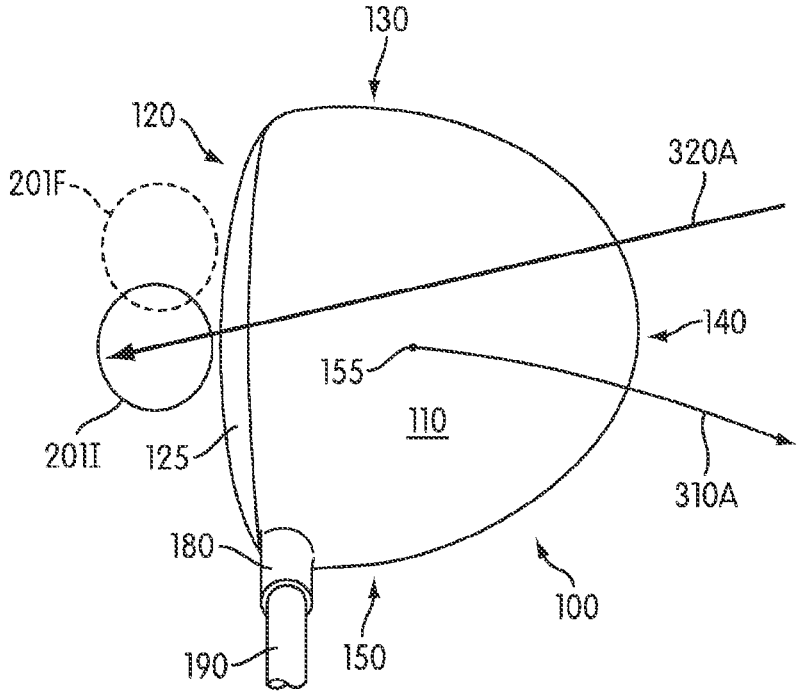
FIGS. 3A and 3B are illustrative top plan views of a golf club head and various exemplary swing paths.
Figure 3B:
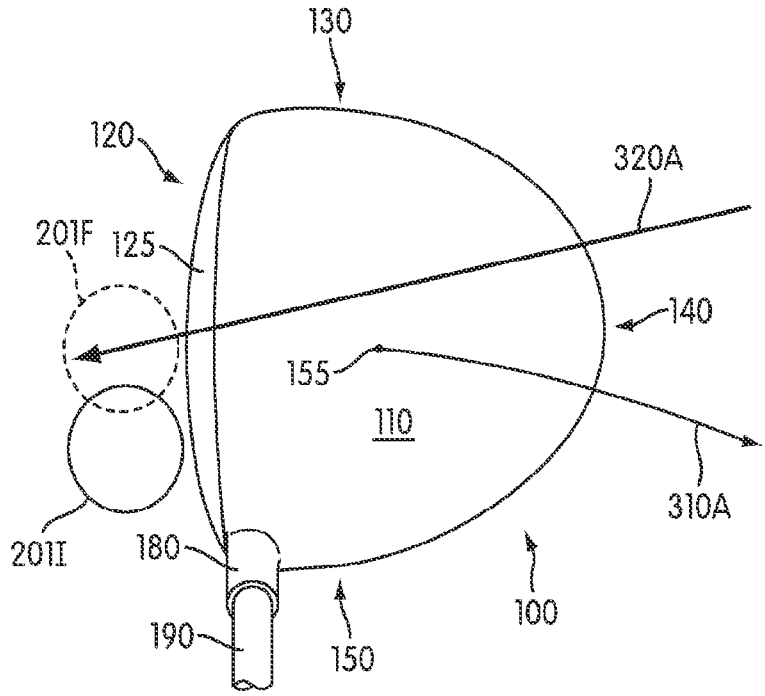

FIGS. 3A and 3B are illustrative top plan views of golf club heads and various exemplary swing paths including illustrative backswings and downswings. A golf swing may generally be considered as having an addressing state followed by backswing in which the club head 110 via the shaft 190 and hosel 180 is generally pulled rearward (and upward) of the golf ball 201 to be hit. During this backswing, the golfer also typically rotates his torso and "shifts his weight" using his legs. In essence, a golfer during the backswing is twisting or coiling his body and/or providing space in anticipation of the downswing motion that will contact the golf ball 201. The golfer 10 may continue his backswing as is known in the art until the golfer 10 reaches a "top" of the swing and then begins a downswing along a downswing path.

A center 155 of golf club head 100 is used as a reference point for further clarity and comparison in demonstrating various swing paths and directions in the figures. FIGS. 3A-3B are illustrative diagrams of a golf club head 100 depicting the swing tendencies of a high handicap player (e.g. a player that has a higher number as their "handicap" according to the well known handicapping system of rating golfers based upon their play and scores.) Generally speaking, as shown in FIG. 3A-3B, a high handicap golf player can have a tendency to "take-away" the golf club head 100 with a more inward (heel end 150) path than recommended by golf pros and conventional swing mechanics. For example, a high handicap golfer may have a tendency to take-away the golf club head 100 from its position shown in the addressing state along the initial backswing path 310A as is depicted. In this instance, the take-away or initial backswing path 310A has a generally inward or heelward path. When a golfer 10 begins his/her backswing along backswing path 310A along this inward or heelward trajectory, he will continue that backswing path until it reaches the top of his/her backswing as is known in the art.

The specific position known as the top of the backswing can vary from golfer to golfer but it is generally know to be at a position when the shaft 190 reaches a parallel position with the ground. Of course, for varying degrees of partial swings rather than full swings this position may be significantly short of this parallel shaft position. Additionally, some golfers especially including professional golfers may have backswings that extend beyond this parallel position when they are attempting to generate significant power and trying to, for example, hit the ball at the maximum distance for a certain club.

A golfer that has an initial backswing path 310A begins the club head with a more inward or heelward path than traditionally desired and will often continue his swing with an overly inward or heelward trajectory. In order to continue this inward backswing trajectory, the golfer's 10 arms are forced inward and are prevented from remaining generally extended as desired according to preferred swing mechanics. The golfer will then reach the top of his swing in a position varied from an optimal top position (for example, arms further inward and cramped and torso rotation not completed).

After reaching the top of the backswing, the golfer will now begin a downswing until the golf club head 100 contacts the golf ball 201 and then the golfer 10 will finish his swing with the "follow-through". Here, because the golfer will reach the top of the backswing in a misaligned position, the golfer will have a tendency to overcompensate, as the golfer uncoils and rotates back towards the initial addressing state for contacting the golf ball 201. For example, the golfer will feel cramped and his arms will be and feel too close too his body to return to an extended position at the time of contact as he moves through the downswing. The golfer may also have trouble returning to an aligned position sufficiently quickly during the downswing so the golfer will feel hurried to "catch-up" during the swing so as to not leave the club face of the golf club open. As a result of the initial backswing path 310A being inward or heelward of a preferred path the downswing path of the golfer 10 will be affected.

As illustrated in FIG. 3A, the golfer will perform a downswing that begins outward of a preferred position. This misalignment will be carried through as the golfer will strike the ball 201 with the hitting surface 125 on the front surface 120 of the golf club head 100 with an askew outward to inward direction through the hitting area as is demonstrated in FIG. 3A. As shown, the golf club head 100 will travel with an ending downswing travel path 320A. Additionally, the front face 120 of golf club head 100 may have a rotated orientation compared to its orientation in the corresponding state of FIG. 2. Accordingly, an incorrect or contrary to convention/preference path of motion and orientation of the golf club head 100 will cause the golf ball 201 to be contacted by the hitting surface 125 of golf club head 100 contrary to a desired orientation and contact direction. Further, this varied ending downswing path 320A will cause the flight path of golf ball 201 to vary from a general desired flight path 202 and after it is contacted by the hitting surface 125, kinetic energy from the golf club head 100 is transferred to the ball 201. The varied resulting ball flight may embody a number of undesirable variations on a desired or optimal ball flight. Distance may be lost. The ball may have a flight path of a slice or fade when a generally straight ball flight is desired. Even if the flight path of the golf ball 201 after being hit by a swing as described in FIG. 3A is generally straight it may be askew directionally due to the path of club head movement 310A at time of contact being diagonal relative to a desired flight path 202. Additionally, a club head front 120 including hitting surface 125 may be rotated relative to a desired "square" or other orientations leading to additional spin or direction variances to be introduced into the resulting ball flight.

FIG. 3B is an illustrative top plan view of a similar golf club head and swing paths including an illustrative backswing and downswing. However, FIG. 3B is varied from FIG. 3A in that the golfer that aligned the golf club head 100 was aligned in an addressing state in a distinct manner. For example, as is apparent from FIGS. 3A-3B, the golf ball's position relative to the golf club head 100 has varied from the initial or addressing state (201I) to the final or striking state (201F). In FIG. 3A, the golf ball is shown as having its relative positioning being varied from an initial state 201I that may be characterized as being centered relative to the hitting surface 125 and generally centered between the toe end 130 and the heel end 150 of the golf club head 100. Accordingly, based upon the swing tendencies a high handicap golfer that begins with the golf ball in the addressing state 201I being centered is likely to strike the golf ball in an off-center positioning (e.g. more toward toe end 130) relative to the golf club head (201F) as shown in FIG. 3A. Thus, especially for high handicap or less skilled golfers, it may be advantageous to have an addressing state that more closely resembles the alignment shown in FIG. 3B. As shown, the golf ball in the initial state 201I is aligned closer to the heel end 150 of the golf club head than to the toe end 130 of the golf club head. As will be discussed in more detail later, this askew alignment is somewhat unnatural and contrary to a typical golfer's "believed" preferred alignment for preparing and aligning to perform golf shots according to a preferred manner.

It is common and well known in golf that a preferred golf shot may be performed when the golf ball is struck with the golf club such that the ball is contacted by the hitting surface 125 in a central or "sweet spot" region so as to optimize distance and control and to minimize undesirable spin and misdirection that may occur if the golf ball is struck by the hitting surface outside of the central region or "sweet spot." Accordingly, golfers generally are taught when they first take up the game of golf that they should place the golf ball at a centered position with respect to the golf club head in an addressing state with the golf ball since it is desirable to strike the golf ball with the golf club head 100 such that the golf ball is in the center of the club head. By placing the golf ball generally centered between the toe end 130 and heel end 150 of the golf club head, the ball will be centered after the golf swing if the golfer performs a backswing and a downswing and thereby returns the golf club head 100 to the same position and orientation as where the golf club head 100 started in the addressing state. However, many golfers including high handicap golfers generally do not return the club head to the same positioning as the addressing position as a result of their swing motions and paths as compared to a preferred manner or "true" swing a golf club. Typically the ball is closer to the toe end 130 than the heel end 150 when the golfer is striking the ball than the ball was when the golf club head was positioned near the golf ball and aligned in the addressing state. Stated another way, many golfers especially including high handicap golfers move the golf club from the addressing state through the backswing and then back through the downswing to return the golf club head to a position shifted further heelward or further toward the heel end plane 250 than the golf club head was originally placed in an addressing state.

Figure 4A:
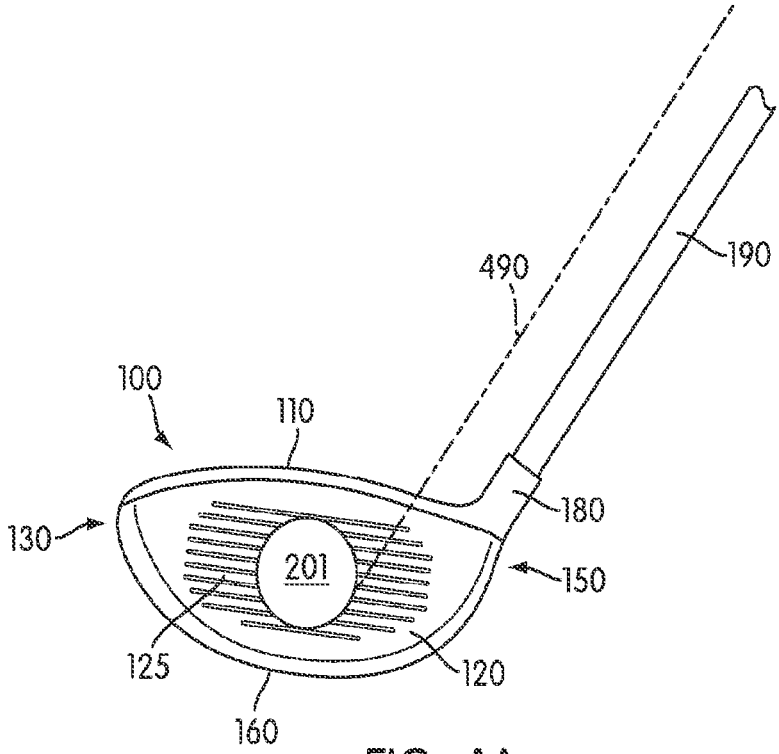
FIGS. 4A and 4B are illustrative front views of a golf club head and various golf club head and shaft orientations.
Figure 4B:
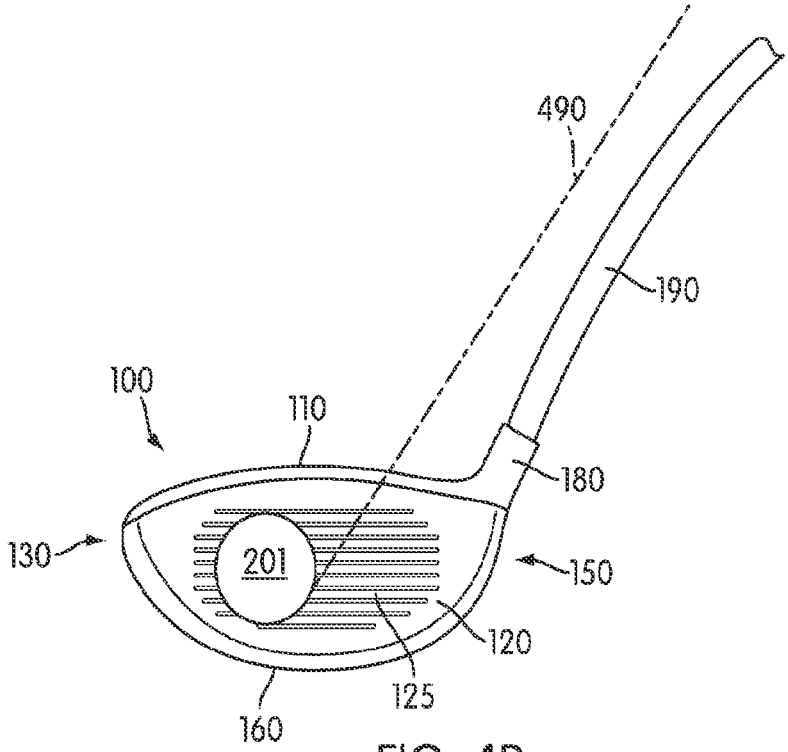
Figure 5A:
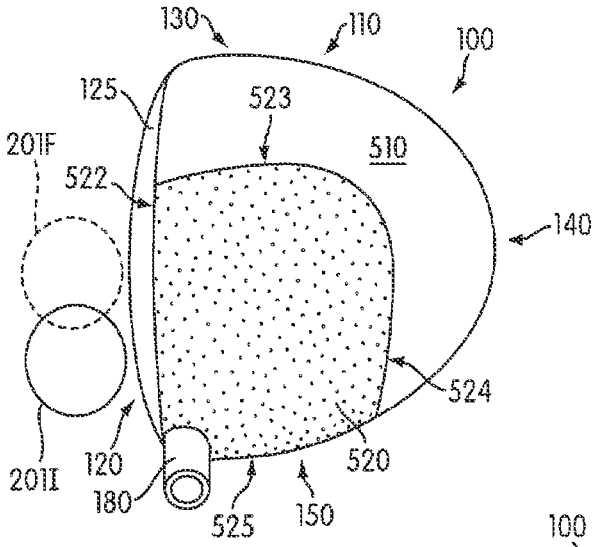
FIGS. 5A-5D are illustrative top plan, toe end, heel end and front views respectively of a golf club head with an illustrative varied top surface visible profile region and an illustrative actual top surface visible profile region.
Figure 5B:
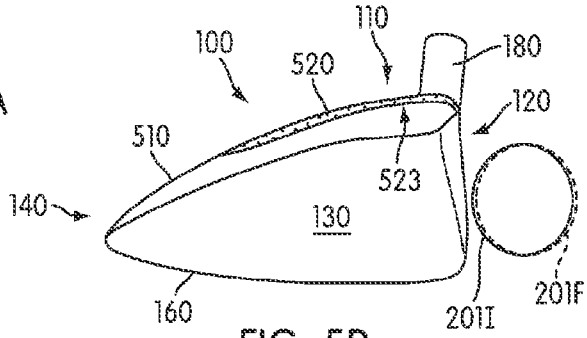
Figure 5C:
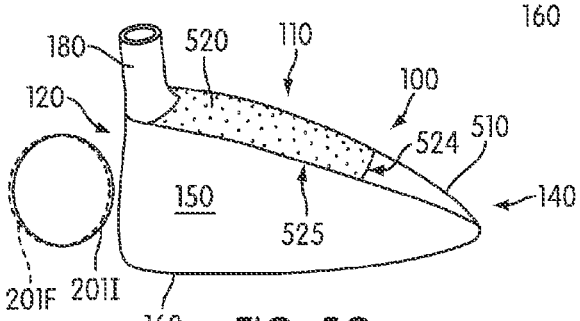
Figure 5D:
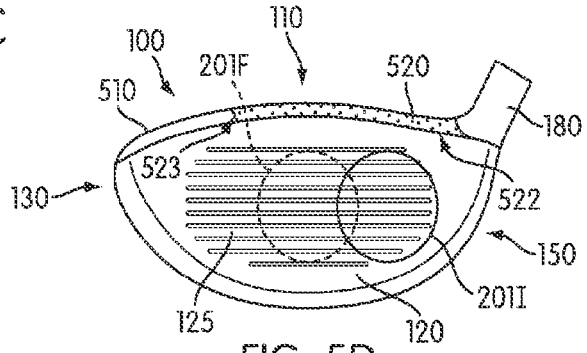

FIGS. 4A-4B illustratively demonstrate another cause of golfers to return the golf club head in a distinct position and/or orientation relative to the golf ball as compared to the alignment of the golf club head with the golf ball during the addressing state. FIGS. 4A-4B illustratively depicts how "shaft droop" that may be present when a golf club is dynamically moved contributes to misalignment of a golfer. In particular variations in alignment between the addressing state and the alignment as the golfer strikes the golf ball during the golf shot may occur accordingly. FIG. 4A is an illustrative diagram of a golf club 199 in a static state, an illustrative example of which is an addressing state of a golfer. As shown, the toe end 130 of the golf club head 100 has a slightly upturned or elevated position and posture and notably the shaft is in an unbent or non-flexed state. Accordingly, FIG. 4A illustrates the golf club 199 in a state in which the shaft 190 lacks "shaft droop." Such a positioning and orientation may be further accomplished during the addressing state as a golfer may rest some or all of the weight of the golf club head on the ground further preventing shaft droop while the golfer is aligning his or her shot.

Next, the golf club 199 is then moved from the addressing state through a backswing and then through a downswing prior to returning to a position in which the hitting surface 125 contacts the golf ball. As a result, the dynamic movement of the golf club 199, especially including the period of movement at the conclusion of the downswing prior to striking the golf ball 201, the golf club may have an orientation as shown in FIG. 4B when the golf ball is struck. In FIG. 4B, shaft 190 has a bent or flexed shape. Rather than the shaft 190 being a straight member between the grip (not depicted) and the golf club head 100, the shaft is curved or bowed between the grip and golf club head when the golf ball 201 is struck. This occurs when the golf club head 100 is attached at one of the opposing ends of the shaft and the golf club head 100 is accordingly varied in position compared to its position in the addressing state. The "shaft droop" results in the golf club head 100 being more inward or heelward relative to the stationary golf ball 201 than it originally was positioned in the addressing state even if the golfer's hands were returned to the exact same location or position as they were in the addressing state. The varied location of the golf club head 100 as a result of "shaft droop" of the dynamically moving golf club 199 is further apparent when compared to shaft reference line 490 illustratively shown in FIGS. 4A-4B.

As is apparent from FIGS. 3A-4B, many golfers return the golf club head 100 heelward of its location in the addressing position for a variety of reasons. As demonstrated, these golfers include high handicap golfers with swing tendencies as described in FIGS. 3A-3B, golfers in general that are affected by shaft droop as shown in FIGS. 4A-4B, and golfers that have swing tendencies or swing traits as are known in the art that result in golfers returning the golf club head heelward of its location in the addressing position. These golfers will be more likely to strike the golf ball 201 in the center of the hitting surface 125 or "sweet spot" if the golfer initially aligns the golf ball 201 such that it is off-center relative to the hitting surface 125. In particular, it may be desirable for these golfers to position the golf ball 201 such that the golf ball 201 is closer to the heel end 150 than the toe end 130 of the golf club head in the addressing state. Thus, when the golfer performs his swing he will strike the golf ball further towards the toe end 130 than the location of the golf ball in the addressing state and this shift will result in the ball 201 being centered in the hitting surface 125 as is desirable in preferred swing techniques. Stated another way, aligning the ball towards the heel end 150 will promote center hits for many golfers. Center hits are desirable as they typically result in preferred golf shots and improved golf scores. While this described off-center set up as shown in FIG. 3B may have positive effects on the golfer's performance including improved distance, accuracy, control and various other attributes, golfers typically find such an alignment unnatural and uncomfortable. In short, it does not "feel" correct.

Many aspects of golf include a "feel" aspect which requires golfer touch, comfort, and confidence for that aspect to be performed according to preferred techniques and manners. For example, golfers may align a golf ball in the center of the golf club head 100 in the addressing state even if they are aware of their tendency to hit the golf ball 201 on the toe end 130 of the golf club head 100 because aligning the golf ball 201 so as to be off-center on a conventional golf club head does not "feel" good or correct. Alternatively, many golfers especially including golfers that play fairly infrequently may be helped by a reminder of a preferred alignment for their particular swing type or manner. This reminder may serve as a visual reminder and also as a visual aide for an initial alignment of the golf club head 100 relative to the golf ball 201.

FIGS. 5A-5D illustratively depict top, toe end, heel end and front views respectively of a golf club head with a top surface formed to create a visual impression of a varied golf club head to assist in alignment. As shown, the golf club head 100 may be considered as having an actual profile which is the profile formed by the entirety of the body of the golf club head when viewed from the top view as shown in FIG. 1A (as well as FIG. 3A, 5A, etc.). However, the golf club head 100 illustratively shown in FIGS. 5A-5D is configured such that the golf club head 100 creates the visible impression to a golfer using the golf club 199 and viewing the golf club head 100 in an addressing state (FIG. 2) that the golf club head 100 has a varied size and/or shape as compared to the actual size and shape of the golf club head. Depending upon where the golfer focuses his or her view, the golf club head 100 has a plurality of varied profiles.

For example, in FIGS. 5A-5D top surface 110 includes actual top surface visible profile region 510 and a varied top surface visible profile region 520. The varied top surface visible profile region 520 is a region of the top surface of the golf club head 100 that is formed so as to create the visual impression of the complete top surface of a golf club head distinct from the actual top surface 110 of the golf club head. The varied top surface visible profile region 520 here is illustratively shaded in a distinct manner from the remainder of the top surface of the golf club head to designate the distinct appearance including distinct material, texture, surface ornamentation and other manners of creating a distinct visual appearance. The varied top surface visible profile region 520 is shaped and configured to appear to be a complete top surface of a golf club head such that when the golfer is in the addressing state the golfer will "feel" as if varied top surface visible profile region 520 forms the entirety of the golf club head that is being swung. As a result of this feel, the golfer may position the golf club 199 and in particular the golf club head 100 such that the varied top surface visible profile region 520 is aligned with the golf ball 201I in the addressing state. In particular, the golfer will position the golf club such that varied top surface visible profile region 520 is aligned with the golf ball 201I with the golf ball 201I sitting centered between the toe end 523 and the heel end 525 of the varied top surface visible profile region 520. As such, the golfer will mimic a typical alignment of a golf club head with the golf ball 201I in a similar fashion as golfers are traditionally taught by focusing on the varied top surface visible profile region 520 as if it was the entirety of the golf club head 100 for alignment purposes. Accordingly, the golf ball 201I will sit centered with respect to the varied top surface visible profile region 520 but accordingly the golf ball 201I will sit slightly heelward of the center of the golf club head in alignment and positioning as has been described above. In such an arrangement the golfer will be able to properly align the golf ball closer to heel end 150 of the golf club head 100 such that when the golfer swings and strikes the ball the alignment of the golf ball with the golf club head will be centered. By configuring a golf club head with a varied top surface visible profile region 520, the desired alignment characteristics may be accomplished while still maintaining the proper "feel" to the golfer that the golf ball 201I is centered relative to the "believed" golf club head. As such a visual impression is created that assists the golfer in alignment of the golf ball in an addressing state in light of the variances that typically occur in the position and orientation of the golf club head between the initial addressing state and the final striking state of the golf club head 100.

Because the varied top surface visible profile region 520 is shown in FIGS. 5A-5D to be a portion of the top surface 110 of the golf club head less than the entirety of the top surface 110 of the golf club head, an actual top surface visible profile region 510 is also apparent in FIGS. 5A-5D. The top surface 110 also includes an actual top surface visible profile region 510 which in this configuration bounds the varied top surface visible profile region 520 on the varied toe end 523 as well as on the varied rear end 524. Additionally, varied front surface 522 forms the heelward most portion of the front surface 120.

As viewed from the perspective of a golfer in the addressing state of FIG. 2, the actual top surface visible profile region 510 in this particular arrangement may be described as having a generally crescent shape. In certain configurations the actual top surface visible profile region 510 may be crescent shaped when the varied top surface visible profile region 520 is utilized with a generally rounded golf club head. This shape may be further utilized to facilitate the visual impression of the top surface being two distinct golf clubs as described. However, depending on the particular configuration of the varied top surface visible profile region 520 and the actual shape of the top surface 100 of the golf club head, the actual top surface visible profile region 510 may take on a number of varied regular and irregular shapes.

FIGS. 6A-6D illustrate several arrangements of a golf club head 100 configured to create a visual impression of a varied top surface profile when viewed by a golfer in an addressing position. The golf club head(s) 100 illustratively shown in FIGS. 6A-6D are formed to assist in preferred alignment of the golf club head relative to the golf ball in an addressing state so that a golfer with particular swing tendencies will strike the golf ball with the golf club head 100 in a preferred position and orientation relative to the golf ball, e.g. such that the ball is centered relative to the golf club head and the golf strikes the golf ball in a "sweet spot" region. In doing so the golfer is more likely to achieve preferred shot characteristics including preferred distance, direction, spin, shaping and various other characteristics as is known to be desirable in the game of golf.

Figure 6A:
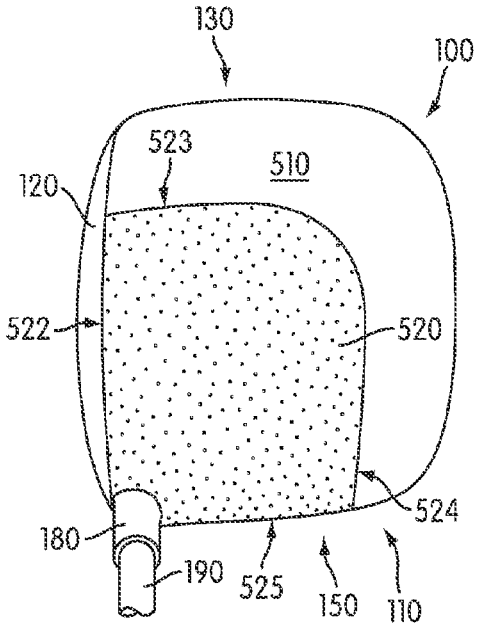
FIGS. 6A-6D are illustrative top plan views of a golf club head with illustrative varied top surface visible profile regions and illustrative actual top surface visible profile regions.

FIGS. 6A-6D illustratively depict a square wood-type golf club head, a rounded shaped wood-type golf club head, a hybrid golf club head, and a golf club head for a putter. As may be noted, a hybrid golf club head may also generally be referred to as a type of wood-type golf club. In FIG. 6A, the square wood-type golf club head 100 (e.g. a driver or 3-wood etc.) includes a square shaped varied top surface visible profile region 520 that is substantially similar in shape to the actual profile of the top surface 110 of the golf club head 100. The actual profile and the varied top surface visible profile region 520 are complementary in shape and appearance in the arrangement of FIG. 6A. This complementary appearance may further facilitate the desired visual impression since the golfer will have a consistent "feel" in viewing the actual profile formed by top surface 110 and the profile formed by the varied top surface visible profile region 520 as the distinction between these two profiles is the size of the golf club head 100 or "believed" golf club head 520. Accordingly, the golfer's eye will be drawn to the varied top surface visible profile region 520 and the golf ball 201 may sit aligned so as to be askew and heelward of center of the hitting surface 125 of the golf club head. However, the golfer will still feel as if the alignment is centered with respect to the varied top surface visible profile region 520. Accordingly, golf club head 100 in the depicted configuration facilitates alignment in an addressing state without causing the golfer to have the "feel" of having the ball initially positioned "off-center" as the golfer's eye will view the varied top surface visible profile region 520 and its relative position with respect to the ball in the addressing state. This visual impression causes the golfer to feel as if the golf club is aligned such the ball is centered. Such a "feel" is accomplished because the golfer's eyes and field of view generally sees a golf ball centered relative to a golf club head even thought the golf club head is actually an "apparent golf club head" as a result of the varied top surface visible profile region 520.

Figure 6B:
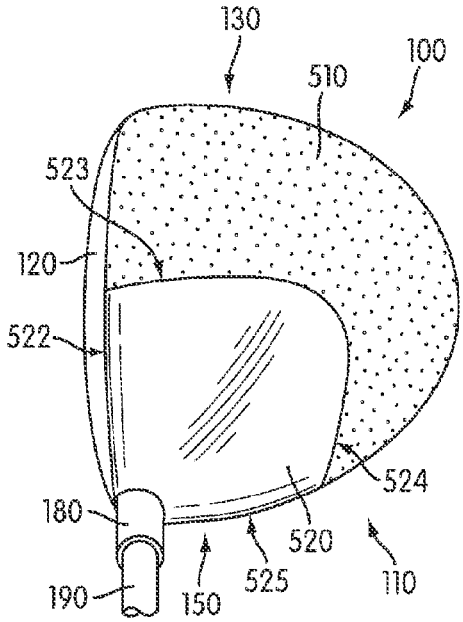

FIG. 6B illustratively demonstrates another arrangement of a golf club head including a further configuration of the varied top surface visible profile region 520. Here, the golf club head 100 is a rounded wood-type golf club head. In this configuration the actual profile of the top surface of the golf club head and the varied top surface visible profile region 520 may be described as having outer perimeter shapes that vary. Distinct from the configuration illustratively shown in FIG. 6A, the actual profile and the varied top surface visible profile region 520 have differing overall shapes. For example, a golf club head 100 with a rounded shape may house a varied top surface visible profile region 520 that may be rectangular or square in shape. Alternatively, a golf club head 100 with a square shape may house a round shaped varied top surface visible profile region 520. Numerous configurations with various combinations of shapes may be utilized consistent with the teachings described herein.

Additionally, FIG. 6B also illustrates that in certain configurations the varied top surface visible profile region 520 and the actual top surface visible profile region 510 have varying appearances as a result of varied material, finish, coloration, surface ornamentation, texture, and related techniques and manners as are known. In particular, FIG. 6B illustratively depicts the actual top surface visible profile region 510 (a portion of the actual profile not forming part of the varied top surface visible profile region 520) as having a matte or non-glossy finish while the varied top surface visible profile region 520 is illustratively shown as being a glossy finish. Likewise, the varied top surface visible profile region 520 can also be made of transparent, translucent, or reflective material to provide a varied visual appearance compared to the appearance of the actual top surface visible profile region 510.

Figure 6C:
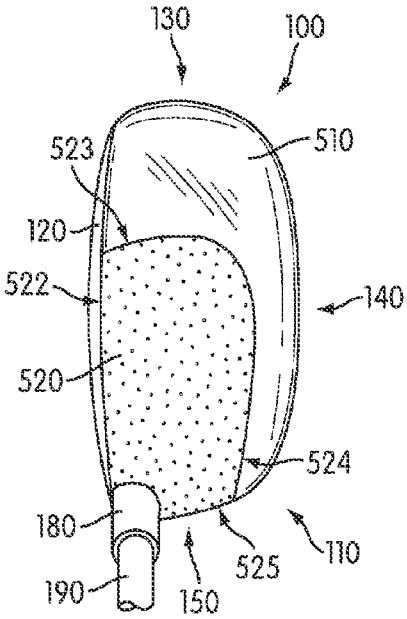

FIG. 6C illustrates the converse regarding the appearance and configuration of the actual top surface visible profile region 510 and the appearance of the varied top surface visible profile region 520 of the top surface 110 of the golf club head. Specifically, the varied top surface visible profile region 520 of the hybrid type golf club head 100 is shown as illustratively having a matte finish while the actual top surface visible profile region 510 has a glossy or shiny finish. While contrasts in shading (stipple and line shading) is used in these two figures (i.e. FIGS. 6B and 6C) to illustratively represent a contrast in appearance, similar shading in other figures should not be assumed to represent such appearance. For example, FIGS. 6A and 6D include stipple shading similar to that as shown in FIGS. 6C and 6B. However, use of the varied shading is merely used to illustrate a contrast in appearance between the actual top surface visible profile region 510 and the varied top surface visible profile region 520 and the figures as a whole should be broadly viewed such that the contrast in appearance may be accomplished as a result of using a variety of materials, finishes, colorations, surface ornamentations, textures, and related techniques and manners to show an contrast of appearance depending on the particular configuration.

Figure 6D:
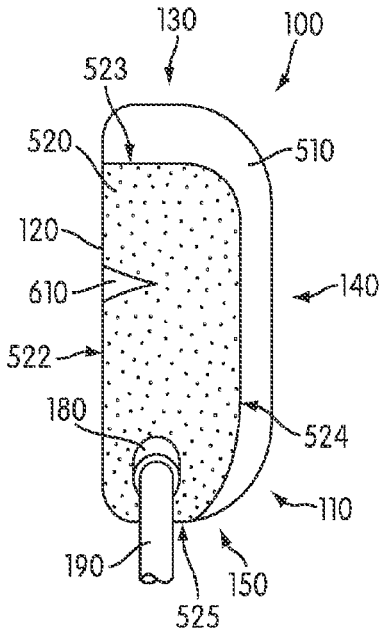

FIG. 6D illustratively depicts a golf club head with an actual top surface visible profile region 510 and a varied top surface visible profile region 520. The golf club head of FIG. 6D, like the arrangement of FIG. 6A, includes an actual profile and varied top surface visible profile region 520 complementary in shape. Here the actual profile formed by top surface 110 and the varied top surface visible profile region 520 are substantially similar in shape and vary mainly in a size aspect. Again, the complementary shape aspects of the varied top surface visible profile region 520 complementary to the actual top surface profile of the golf club head 100 as depicted further facilitates the visual impression of the varied top surface visible profile region 520 being the entirety of the golf club head 100 when viewed in a desired manner by the golfer in the addressing position such as the position of FIG. 2. As illustratively demonstrated in FIG. 6D, the golf club head 100 may also include an alignment aide 610 that facilitates the user in identifying the center of the actual golf club head. As such, the golf club head 100 in the arrangement of FIG. 6D includes an alignment aide 610 configured to assist a golfer desiring to address the ball such that the golf ball sits centered with respect to the actual golf club head. Additionally, the same golf club head includes a varied top surface visible profile region 520 positioned to assist the golfer in aligning the golf club head in the addressing state such that when the golf ball is aligned with the varied top surface visible profile region 520 the ball is positioned in a preferred location for the golfer to strike the golf ball after swinging with the golf ball being in the center of the golf club head or the "sweet spot." Accordingly, the golf club head facilitates a plurality of alignments, a centered alignment such as a traditional addressing alignment as well as an askew alignment based upon the location of the varied top surface visible profile region 520 that facilitates proper alignment when the golf ball is struck during the golfer's swing. As such, the golfer may vary his or her alignment between shots depending upon play in that round and other varied factors.

As is apparent, each of the configurations of the golf club heads depicted in FIGS. 6A-6D provide a visual impression in which the single hose 180 and shaft 190 appear to serve as a hosel and shaft of two distinctly appearing golf club heads, one being smaller in size compared to the other. Accordingly, depending what portion of the golf club head the golfer focuses his eyes, one of the two varied golf club heads is the predominantly visible golf club head. As such, a golf club head configured with varied top surface visible profile region 520 is able to provide an alignment aide for aligning the golf club head relative to the golf ball to specifically accommodate unique characteristics and tendencies of the golfer's swing while maintaining the golfer's feel. Likewise, the golfer will not have to guess first as to where the center of the golf club head is and then guess as to how far off center (and closer to the end heel end 150) the golf ball needs to be when the golf club is placed in the addressing position. Instead, the golf club head is formed and constructed to take into account the golfer's natural swing tendencies, shaft droop or other factors that cause the location of the ball relative to the club to shift from the addressing state to the final striking state and provide alignment assistance accordingly. The golfer can merely address the golf ball such that the golf ball is aligned with the varied top surface visible profile region 520 (for example with the center of this region or with a further alignment aide in this region as will be discussed later) that has been configured to take varied swing tendencies and characteristics into account. As such, the golfer may reliably align the golf ball based upon the position of the varied top surface visible profile region 520.

Figure 7A:
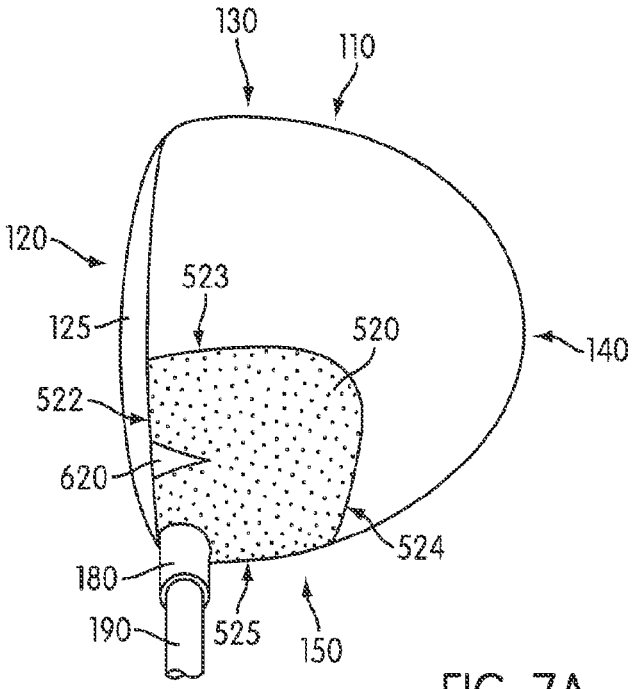
FIGS. 7A-7B are illustrative top plan views of a golf club head with illustrative varied top surface visible profile regions, illustrative actual top surface visible profile regions and alignment aide(s).
Figure 7B:
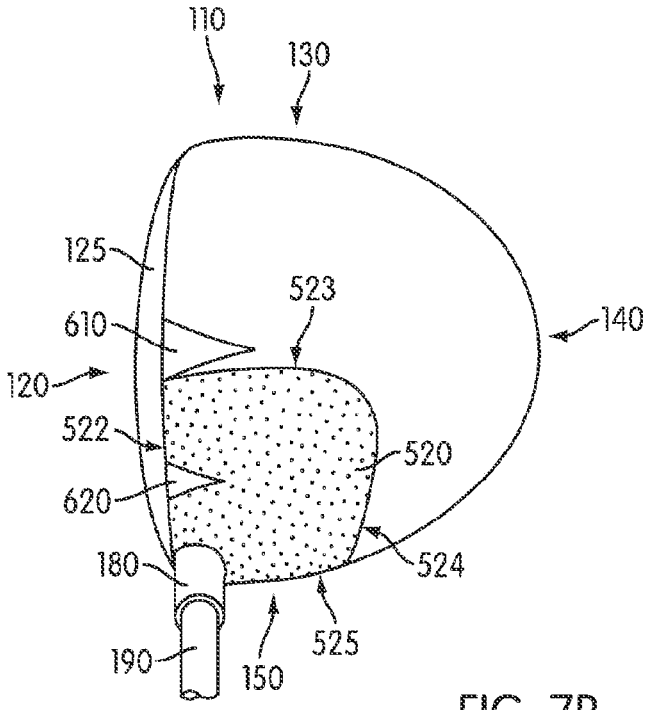

FIGS. 7A-7B are further arrangement of the golf club head including a top surface 100 that houses varied top surface visible profile region 520. Here, the golf club heads shown in FIGS. 7A and 7B include a varied profile alignment aide 620. The varied profile alignment aide may be positioned in any of a varied number of locations on the top surface of the golf club head within the varied top surface visible profile region 520. Often, the varied profile will be centered within the varied top surface visible profile region 520 between the varied toe end 523 and the varied heel end 525; however, various other configurations may be utilized. Stated another way, the alignment aide 620 may be positioned at a midpoint between the varied toe end 523 and the varied heel end 525 to further provide the desired visual impression to the golfer. FIG. 7B includes a varied profile alignment aide 620 as well as an alignment aide 610 both housed on the top surface 110 of the golf club head 100. While the alignment aide 610 and varied profile alignment aide 620 may be positioned in a variety of locations, the varied profile alignment aide 620 is housed within the varied top surface profile region 520 while alignment aide 610 may be located either within the varied top surface profile region 520 or it may be located elsewhere on the top surface 110 including in the actual top surface visible profile region 510. In certain arrangements the varied profile alignment aide 620 will be spaced the approximate distance from the alignment aide 610 that the golfer's swing causes the alignment of the golf club head to shift from the addressing state to the striking state as described previously. For example, as described earlier, for some golfers this distance may be a quarter of an inch to a half inch, others a bit more while others may be less. So by placing the varied profile alignment aide 620 the distance from the actual center of the front 120 of the club that the strike point is expected to shift towards the toe end 130 due to club droop and/or an improper swing, the golfer will then be assisted in striking the ball in the center of the front surface 120 of the golf club head 100.

Accordingly, as described previously, a golfer may vary his alignment from shot to shot depending on play. Hence, multiple alignment aides may assist the golfer at various times. Alternatively, a golf club head 100 that has both alignment aide 610 and varied profile alignment aide 620 permit continued preferred use of the golf club should the golfer's swing tendencies change, improve or vary. For example, high handicap golfers often continue to practice including taking golf lessons with golf professionals to improve their golf swing. Often a golf club purchase especially including purchase of drivers and other more expensive clubs are purchases that are not made yearly or with extreme frequency. As such, if a golfer's swing varies or improves, a golf club with a golf club head that has both alignment aide 610 and varied profile alignment aide 620 allows the golfer to avoid purchasing a new club because the alignment aide no longer is properly positioned for their swing. Additionally, use of both alignment aide 610 and varied profile alignment aide 620 potentially allows use of the golf club by a plurality of golfers.

Figure 8A:
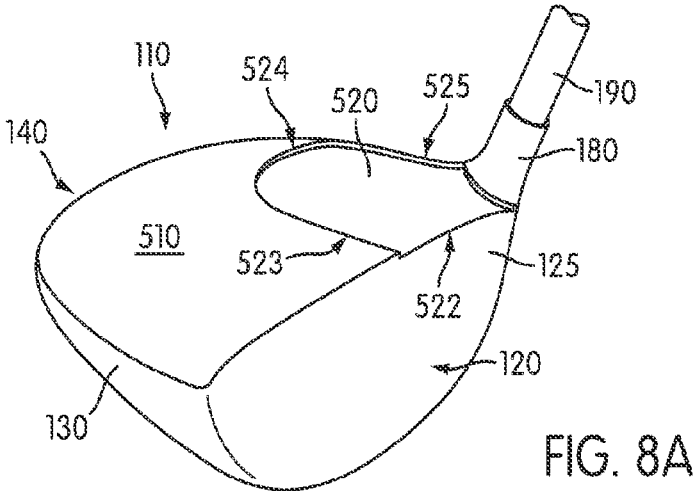
FIGS. 8A-8C are illustrative perspective views of several configurations of the varied top surface visible profile region of a golf club head.

Also, many manners of incorporating the varied top surface profile region 520 into the golf club head 100 are contemplated. In one configuration a golf club head may be formed during the manufacturing process to include the varied top surface profile region 520 as a portion of the top surface of the golf club head 100. In such a configuration, the varied top surface profile region 520 may be formed as part of a golf club head 100 as a unibody member. Accordingly, a molding or casting or related manufacturing processes that may be used to form the golf club head may account for the varied top surface profile region 520 such that a mold is formed to include the varied top surface profile region 520 feature as desired. Also, the varied top surface profile region 520 may be a protruding structure or extending upward off the top surface such that a generally smooth top surface 110 is interrupted by a varied top surface profile region 520 extending upward beyond the general plane of the top surface 110. Alternatively, the varied top surface profile region 520 may be formed such that the entire varied top surface profile region 520 is formed as a recess in the top surface 110 of the golf club head 100 as is illustratively depicted in FIG. 8A. A recessed varied top surface profile region 520 may exhibit some preferred characteristics as the visible impression created by the varied top surface profile region 520 may be more apparent visually to the golfer 10 during the addressing state as well as during the initial movement of the golf club head 100 during an initial take-away because the three dimensional aspects may provide further enhance visibility qualities. Further visual enhancements may be used such as contrasting or coloring of the varied top surface profile region 520 or contrasting or coloring the sides of the recessed varied top surface profile region 520 to further make the varied top surface profile region 520 apparent to golfer 10 during alignment of a golf club 199.

Figure 8B:
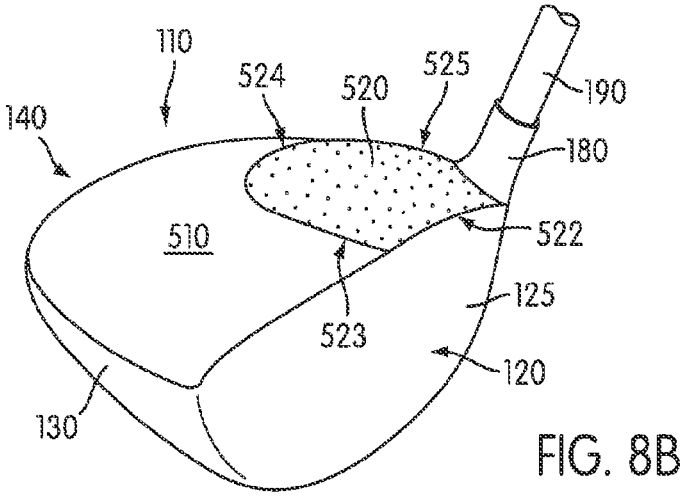
Figure 8C:
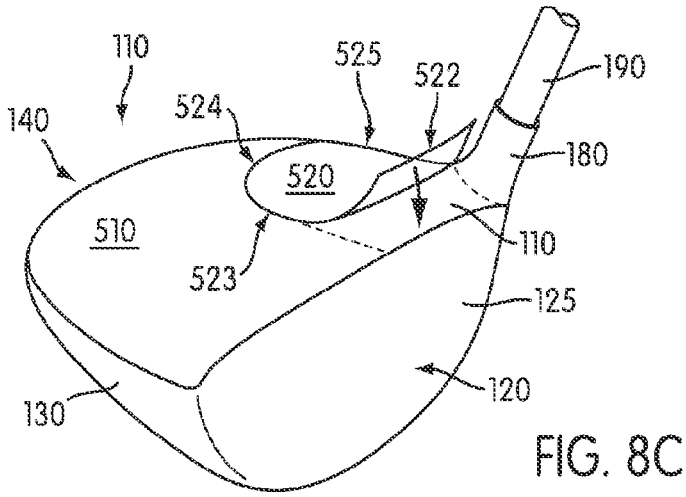

In further configurations, the varied top surface profile region 520 may be applied to a top surface 110 of the golf club head 100 after the golf club head 100 has been cast, molded or otherwise formed as is known in the art. Generally speaking, a varied top surface profile region 520 may be attached to a top surface 110 of the golf club head 100 as a coating (including paint), a film, an adhesive, an appliqué or various other forms of application. After the golf club head is formed of a material, often a metal, the surfaces of the golf club head 100 are treated and coated to improve the durability of the metal and golf club 199 and/or make the golf club head 100 more appealing. Accordingly, a varied top surface profile region 520 may also be applied in a similar manner during these painting, coating and related treatment processes during manufacturing of the golf club head 100. A varied top surface profile region 520 may also be applied to existing golf club heads 100 in a similar fashion as a further coating, film, paint, or the like. Newly manufactured clubs and previously manufactured or after market clubs may be fitted for a varied top surface profile region 520 and can be painted on, applied as an adhesive tape, or through an appliqué (including stickers) as desired. FIG. 8 illustratively demonstrates a varied top surface profile region 520 in the configuration of an adhesive tape or appliqué being placed on a top surface 110 of a golf club head 100.

Golf professionals are known to work with golfers to assist them in improving their golf game including their swing and associated play by analyzing the golfer's tendencies, providing instruction and recommendation regarding modifications to their swing and also in recommending various equipment including selection of clubs. Further, a golf professional for a certain golf manufacturer may offer a selection of features for which the golfer may select either alone, or with the assistance of the golf professional. Among the features that vary from golf club head to golf club head may be particular varied top surface profile region 520 housed on the top surface 110. Each golfer may have a swing tendency that is varied from other golfers. Therefore, a series of varied top surface profile regions 520 may be available for attachment and use depending on the particular golfer's tendencies needs and desires.

The particulars of the golf club head 100 may be varied in any of a number of varied configurations utilizing an attachment means for attaching the varied top surface profile region 520 to the remainder of the golf club head. The varied top surface profile region 520 may be snapped onto a top surface, slid and locked into place or applied as an appliqué, paint or the like. For example, the varied top surface profile region 520 and the top surface may have complementary male and female components to form a connection as is know in the art. Snaps, slider mechanism, track and followers and numerous other mechanisms are known. The varied top surface profile region 520 may be housed on a member configured with a complementary structure for attachment to a structure housed on a top surface 110 of the golf club head 100. In other configurations, the attachment mechanism may include a top surface 110 may be removed and replaced with a different top surface including either a top surface 110 with a varied top surface profile region 520 or another "distinct" varied top surface profile region 520 depending upon whether the golf club head 100 originally included a top surface 110 without a varied top surface profile region 520 or with a varied top surface profile region 520. Varied top surfaces 110 may be snapped into place or be attached using an adhesive such as glue or other known securing substances. Additionally, varied top surface profile region 520 may be applied as a temporary sticker or other appliqué and then removed and replaced with another distinct varied top surface profile region 520. As such, varied top surface profile region 520 in such a configuration may be considered replaceable. Various mechanisms consistent with the principles described above and further herein are contemplated for use with varied configurations of top surfaces and varied top surface profile region 520 and associated alternate means.

Figure 9:
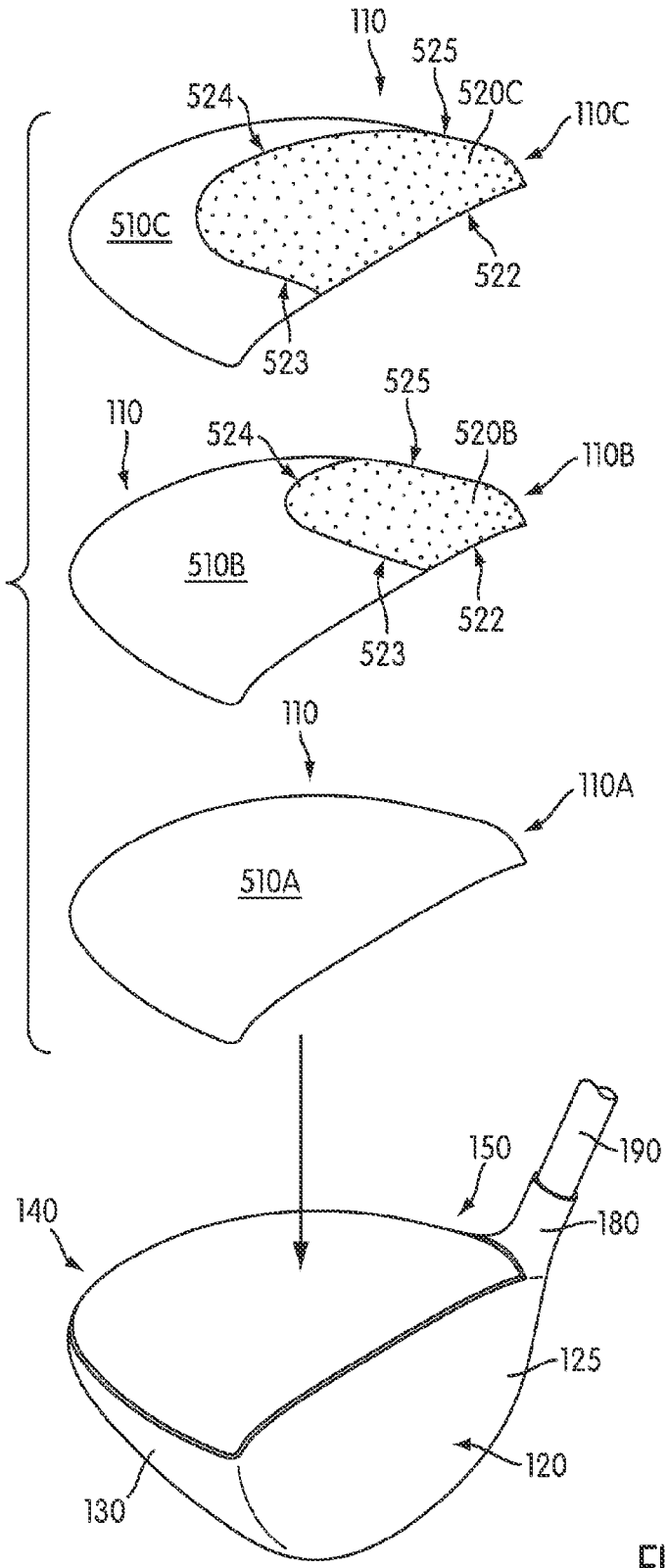
FIG. 9 is an illustrative exploded perspective view diagram of a golf club head with a number of varied top surfaces housing varied top surface visible profile regions.

FIG. 9 is an exploded illustrative view depicting a schematic diagram of a golf club head 100 with a removable top surface 110. A top surface of a golf club head 100, especially including a wood-type golf club head, may also be referred to as a "crown" of the golf club head 100. Here, FIG. 9 illustrates three top surfaces 110A, 110B, and 110C that may used with the golf club head 100 in an interchangeable fashion. Top surface 110A is a conventional top surface without a varied top surface profile region 520. The golf club head may come with a top surface 110A as a standard top surface. Top surfaces 110B and 110C are top surfaces including varied top surface profile regions 520. The varied top surface profile regions 520B and 520C may vary by shape, size, and/or orientation. Accordingly, a particular golfer may choose between a variety of top surfaces 110B, 110C of a golf club head and select one of the top surfaces 110B, 110C. In one configuration, a golf fitting professional may provide a cart or display housing various top surfaces that either a golfer may select or the golf fitting professional may recommend based upon the tendencies of the golfer as measured during analysis of the golfer's swing.

Additionally, in a fitting process, a golfer may have his swing analyzed by a professional either visually or by using any of various measuring and analysis devices as are known in the art and will be described further below. Based upon these measurements and analysis of the golfer's swing and swing path as a compared to an actual desired swing path, a given top surface 110B or 110C may be chosen for facilitating an improved golf swing as described previously. Accordingly, a series of top surface 110A, 110B, 110C can be made available such that a variety of golfers having different characteristics, preferences and specific swing paths may use different top surfaces with varied top surface profile regions 520B, 520C from the series. While FIG. 9 illustrates a series of top surfaces 110 including three distinct club top surfaces, it is contemplated that a series could include a larger number (e.g. 6, 10, 18 etc) of top surfaces housing varied top surface profile regions 520B, 520C so as to provide the desired level of personalization for fitting a golfer with a golf club head 100 with a varied top surface profile region 520B, 520C for assisting the golfer in overcoming a given tendency.

While a golfer may be fit with a golf club head with one of a series of top surfaces 110A-110C at a golf shop, securing of the chosen top surface 110A-110C may need to be performed at a manufacturing location in order for a top surface 110 to be integrally formed (e.g. cast). Alternatively, in order for a sophisticated adhesive process and/or material be applied to sufficiently hold the top surface 110 selected on the remainder of the golf club head 100 during various swinging and related movements, the manufacturing of the golf club head 100 may be performed. Additionally, a golfer may use a demonstration or exemplary golf club to select a preferred golf club head from a series and then the golfer may select a desired golf club head 100. The top surface may each be one in a series of top surfaces having varied top surface profile regions 520B, 520C that vary in orientation by incremental variances for selection by the golfer (perhaps with assistance). Once a particular top surface 110 (and associated varied top surface profile region 520B, 520C) is chosen, an order may be placed for this particular model of golf club head and a golf manufacturer or other company at the manufacturer's direction will produce a copy of that golf club 199 including a golf club head 100 having a varied top surface profile region 520B, 520C in the orientation and particulars selected by the golfer/customer.

Figure 10A:
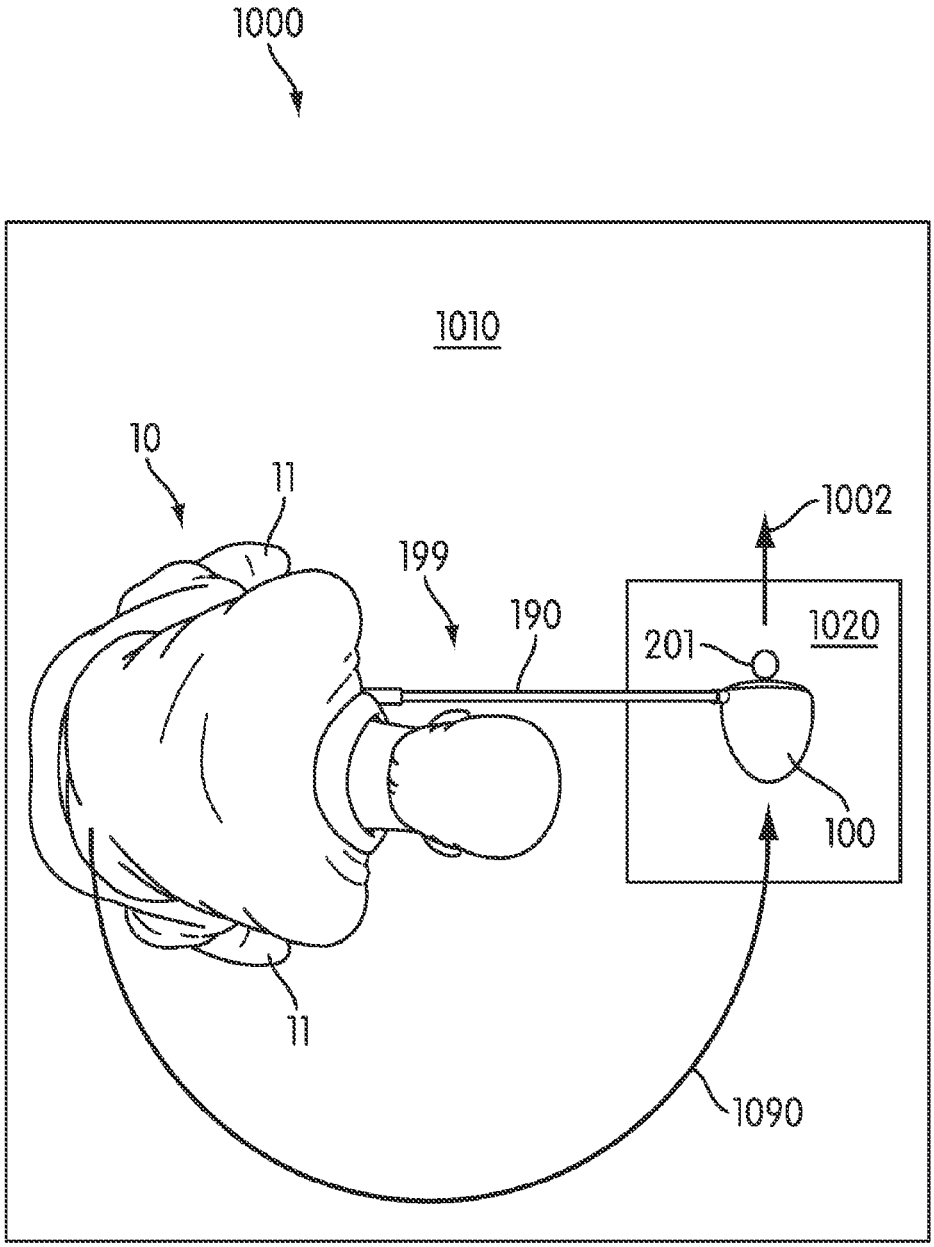
FIGS. 10A-C are illustrative diagrams depicting various aspects of a method of fitting a golf club head.
Figure 10B:
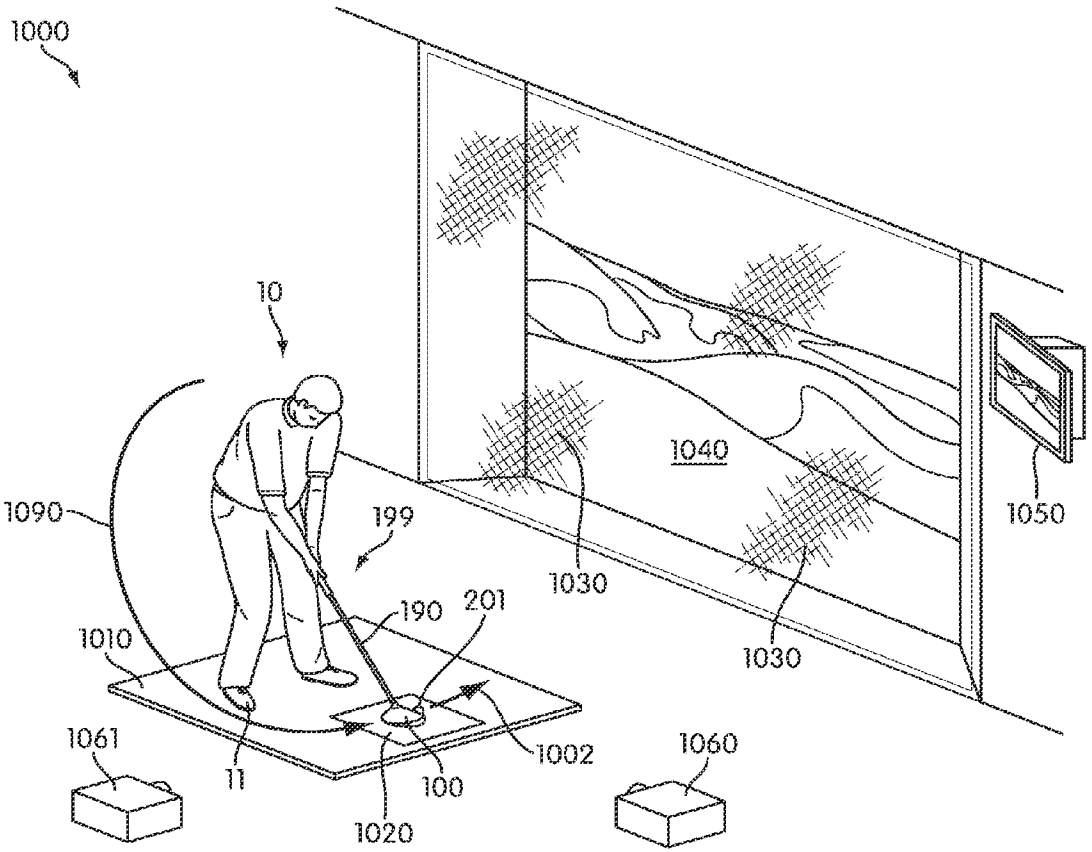
Figure 10C:
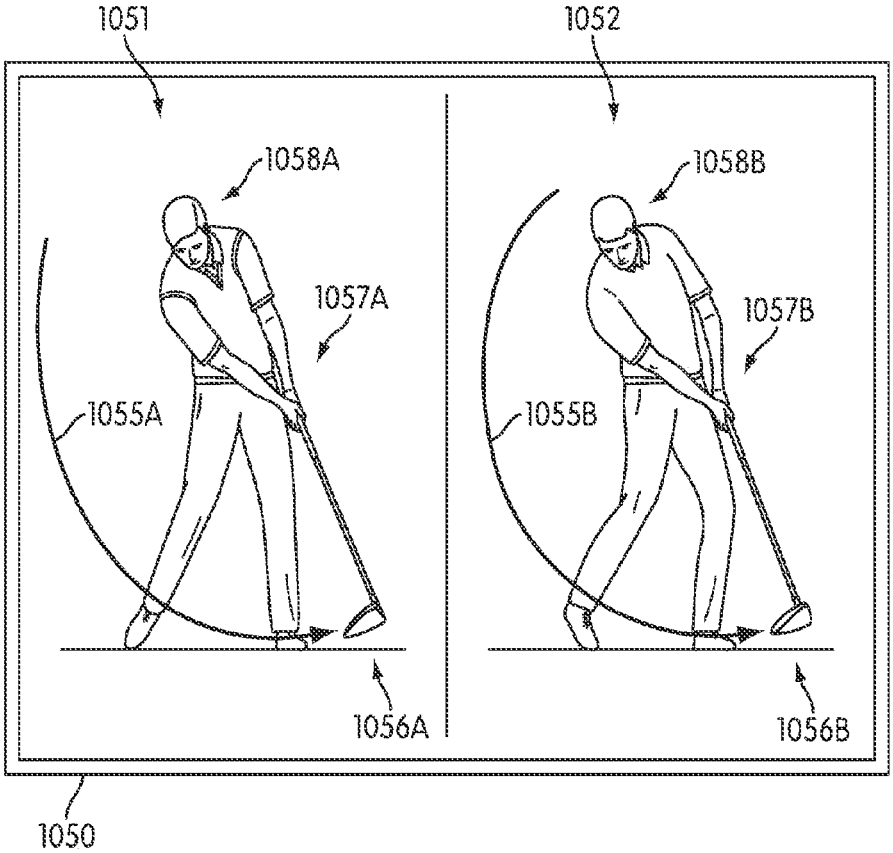

FIGS. 10A-10C illustratively depict one manner of fitting a golf club 199 including a golf club head 100. As is known, a golfer 10 may perform a number of swings in front of one or more golf professionals or golf club fitters. The movements including the golf swing may be viewed, recorded, and/or measured by a measuring device including a videographic device like a digital videocamera. FIGS. 10A and 10B illustrate top plan and rear views respectively of a golfer swinging a golf club and hitting golf balls in an illustrative fitting station 1000. The fitting station 1000 may have any of a number of arrangements and features. The fitting station 1000 shown in FIGS. 10A-10C is an indoor fitting station. However, fitting stations 1000 may be indoor or outdoor and may be located at a driving range or other practice facilities, at a golf course including in or near a pro shop and various other locations as are known. The fitting station 1000 may include a hitting mat 1010, especially when the fitting station is an indoor station or when the station is part of a driving range. Also, a fitting station may be provided on a grass tee box or other outdoor natural golf environment. Here, the indoor fitting station 1000 also includes a net 1030 that a golfer 10 may hit the ball into in performing his or her shots, practice swings and swings in front of a golf professional or golf club fitter. The net 1030 permits the fitting to be done in a more limited space such as indoors, in a pro shop or in a driving range with limited land available. Behind the net 1030 may be a background 1040 or other structures that may make the golfer feel as if he is on the golf course. Also, while not specifically depicted, the background may house or protect a further measuring device(s) including velocity or force sensors, videographic devices and other devices that may be utilized in the fitting of the golfer.

The ball travel of a golfer's shot may be monitored by watching an entire ball flight at a fitting station on a driving range that possesses sufficient space for the ball to travel until it comes to a natural stopping point/lie. Also, a golfer may hit in a confined spaced monitored by a digital video camera or other computing devices that can determine the travel path based upon initial characteristics of the shot including velocity, trajectory, spin etc. Further measuring devices may be used to further understand the swing path and related tendencies of a golfer. In one example configuration, a golfer's swing may be filmed using a digital video camera device 1060. In particular the golfer's swing may be filmed from a toe end view such that the golfer has a stance square to and facing the camera. In another configuration, the golfer's swing my alternatively or additionally be filmed by a measuring device positioned at a position such as the position where measuring device 1061 is illustratively shown as being. By filming the golfer's swing from square orientations such as the rear and toe end, the video may be compared to images and swing paths performed and recorded by a golfer having preferred mechanics as is shown in FIG. 10C.

Among the devices and tests that may be used to monitor the swing path, contact orientation and related characteristics of a golfer swing are video recording, radar tracking including Doppler radar technology, motion detection devices, speed radar devices, ball flight tracking devices and monitoring systems and similar golf swing analysis devices as are known in the art. Illustrative measuring devices 1060, 1061 may be positioned as shown in FIG. 10B. These devices may also be positioned in front of the golfer 10 such that the golfer is hitting at the measuring device or on the heel end side of the golfer behind the golfer's back. Even further, measuring devices may be placed overhead or practically anywhere such that the measuring devices can record data such as video images of the golfer's movements or track and record data or characteristics associated with the portions of the golf club or ball movement such as velocity, direction, orientation, and other characteristics as are known. Other devices focused at determining the golf club's orientation during the swing and in particular the orientation of the golf club through the hitting zone when the golf club head strikes the golf ball may be utilized. These devices may be the same or similar devices as the videographic, radar or other motion tracking devices or the devices may be as simple as lie board devices which depict where a bottom surface of the golf club contacts the ground and the direction of movement and orientation of the club through the hitting zone. Also basic tape devices placed over the hitting surface 125 of a golf club head may be used to provide data regarding the portion of the hitting surface 125 where the golf ball is being hit to determine whether the ball is being hit in a sweet spot or off-center such that the swing or club may need adjustment to optimize results.

After a sufficient number of swings and "practice" or "sample" shots have been made to provide a desired sampling of shots to provide for a reliable fitting, the golf and/or fitting professionals can use the data collected to recommend a particular golf club head 100 housing a varied top surface profile region 520 that will help the golfer performing a golf swing more regularly according to traditional preferred swing mechanics. Among the characteristics collected or measured may include swing path data, trajectory, orientation of the golf club on impact, ball spin, ball flight and physical dimensions and ergonomic characteristics of the golfer, to name just a few. The analysis of the swings including swing patterns can be used to determine a desired swing path, tendencies of the golfer's swing, and changes to the golfer's current swing path such that the specific changes required may be more visibly noticeable.

FIG. 10C illustrates a display 1050 depicting two respective swing characteristics outputs 1051, 1052 illustratively depicting two swings of golfers in videographic form such as a digital video. In one arrangement the displayed swing 1051 may be a videographic image of preferred swing of a professional golfer or other golfer including a "virtual golfer" with preferred swing mechanics. On the right, the golf swing 1052 may be an actual swing of a golfer 10 currently being analyzed in the fitting station 1000. Through the split screen comparison on display 1050, a golfer may be analyzed and fitted for a particular golf club features such as varied top surface profile regions, shaft characteristics, and alignment aides and other features to facilitate a golfer swinging in a preferred manner to achieve preferred performance. For example, backswing paths 1055A, 1055B of the golfers may be compared during the swings 1051, 1052. Likewise, the orientations of the golf club head 1056A, 1056B, the golfers' arm and hand positions 1057A, 1057B, and the head positions 1058A, 1058B may be compared visual. Other comparisons and analysis may be performed as is known. While the display 1050 here illustrates videographic information relating to the golfers' swings, the display 1050 may be utilized during other aspects of the analysis including output of various other characteristics utilized in fitting the golfer 10. Further, as shown in FIG. 10B the display 1050 may also be used to enhance the fitting experience and may be visible to the golfer during the fitting process. For example, certain shaft stiffness cha However, various configurations of outputs can be used to perform a swing analysis and provide output data relating to the golfer's swing to the golfer or the golf professional.

The present invention is disclosed above and in the accompanying drawings with reference to a variety of embodiments. The purpose served by disclosure of the embodiments, however, is to provide an example of the various aspects embodied in the invention, not to limit the scope of the invention. One skilled in the art will recognize that numerous variations and modifications may be made to the embodiments without departing from the scope of the present invention, as defined by the appended claims.

The invention claimed is:

1. A wood-type golf club head comprising:

a body;

a top surface of the body housing an actual top surface visible profile region and a varied top surface visible profile region, wherein the varied top surface visible profile region is configured to provide a visual impression of a varied profile of the body distinct from an actual profile of the body, extends along a front edge and a heel end and is spaced from a rear end of the top surface of the body housing, and a distance from all points along the heel end to a midpoint of the area of the varied profile is less than a distance from each of those points to a midpoint of the area of the actual profile.

2. The wood-type golf club head of claim 1, wherein the varied top surface visible profile region is located at a heel end of the top surface of the body so as to provide a visual impression that a hosel of the body forms the hosel for each of the varied profile of the body and the actual profile of the body.

3. The wood-type golf club head of claim 1, wherein the varied top surface visible profile region has a smaller surface area than the top surface of the body.

4. The wood-type golf club head of claim 3, wherein the varied top surface visible profile region and the actual top surface visible profile region together form an entire top surface of the body.

5. The wood-type golf club head of claim 1, wherein the varied top surface visible profile region and the top surface of the body are distinct in one of shape and coloration.

6. The wood-type golf club head of claim 5, wherein the varied top surface visible region is lighter in coloration than the actual top surface visible profile region.

7. The wood-type golf club head of claim 1, wherein the varied top surface visible profile region has a glossy finish and the actual top surface visible profile region has a matte finish.

8. The wood-type golf club head of claim 1, further comprising an alignment aide, wherein the alignment aide is housed on the top surface of the body and aligned with a center of a hitting surface housed on a front surface of the body.

9. The wood-type golf club head of claim 1, further comprising an alignment aide housed on the varied top surface visible profile region.

10. The wood-type golf club head of claim 9, wherein the alignment aide is housed at a midpoint between a varied club head toe end and a varied club head heel end.

11. The wood-type golf club head of claim 1, further comprising first and second alignment aides, wherein the first alignment aide is housed on the top surface of the body at a midpoint between the toe end and the heel end of the body and the second alignment aide is housed on a varied top surface visible profile alignment region at a point closer to the heel end than the first alignment aide.

12. The wood-type golf club head of claim 1, wherein the varied top surface visible profile region comprises one of a coating, a film, an adhesive tape, and an appliqué housed on the top surface of the body.

13. The wood-type golf club head of claim 1, further comprising a shaft coupled to the golf club head.

14. A wood-type golf club comprising:

a body;

a shaft coupled to the body at a hosel; and a top surface housed on the body and configured to provide a visual impression of the body having a varied profile distinct from an actual profile of the body, wherein the varied profile extends along a front edge and a heel end and is spaced from a rear end of the top surface of the body housing, and a distance from all points along the heel end to a midpoint of the area of the varied profile is less than a distance from each of those points to a midpoint of the area of the actual profile.

* * * * *